US012559896B2

(12) United States Patent
Takeuchi

(10) Patent No.: US 12,559,896 B2
(45) Date of Patent: Feb. 24, 2026

(54) GROUND IMPROVEMENT BODY

(71) Applicant: TAKEUCHI CONSTRUCTION CO., LTD., Mihara (JP)

(72) Inventor: Kinji Takeuchi, Mihara (JP)

(73) Assignee: TAKEUCHI CONSTRUCTION CO., LTD., Mihara (JP)

( * ) Notice: Subject to any disclaimer, the term of this patent is extended or adjusted under 35 U.S.C. 154(b) by 63 days.

(21) Appl. No.: 18/725,052

(22) PCT Filed: Nov. 10, 2022

(86) PCT No.: PCT/JP2022/041961
§ 371 (c)(1),
(2) Date: Jun. 27, 2024

(87) PCT Pub. No.: WO2023/132126
PCT Pub. Date: Jul. 13, 2023

(65) Prior Publication Data

US 2025/0171974 A1 May 29, 2025

(30) Foreign Application Priority Data

Jan. 7, 2022 (JP) ..... 2022-001537

(51) Int. Cl.
*E02D 3/00* (2006.01)

(52) U.S. Cl.
CPC ..... *E02D 3/00* (2013.01)

(58) Field of Classification Search
CPC ..... E02D 3/00
See application file for complete search history.

(56) References Cited

U.S. PATENT DOCUMENTS

| | | | | |
|---|---|---|---|---|
| 5,368,043 | A | 11/1994 | Sunouchi | |
| 2018/0344890 | A1 | 12/2018 | Watanabe | |
| 2020/0141082 | A1 * | 5/2020 | Takeuchi | E02D 3/12 |
| 2022/0042271 | A1 * | 2/2022 | Takeuchi | E02D 27/26 |

FOREIGN PATENT DOCUMENTS

| | | | |
|---|---|---|---|
| JP | H06-098865 | A | 4/1994 |
| JP | H07-229153 | A | 8/1995 |
| JP | H08-302667 | A | 11/1996 |
| JP | H09-038189 | A | 2/1997 |
| JP | 3608568 | B1 | 1/2005 |
| JP | 2007239187 | A * | 9/2007 |
| JP | 3150894 | U | 6/2009 |

(Continued)

OTHER PUBLICATIONS

Y. Kobayashi; "A Long Life Built by Mastication and Occlusion"; Japan Prosthodontics Journal; vol. 3; No. 3; 2011; pp. 189-219 (31 pages, 31 pages translation, 62 pages total).

*Primary Examiner* — Kyle Armstrong
(74) *Attorney, Agent, or Firm* — Kratz, Quintos & Hanson, LLP

(57) ABSTRACT

A ground improvement body includes a horizontal plate-shaped upper improvement body and a lattice-shaped lower improvement body. The depth of the lower improvement body is gradually increased from an outer peripheral part of the ground improvement body toward a center part of the ground improvement body. Thus, ground contact pressure of the ground improvement body is balanced between its outer peripheral part and center part.

6 Claims, 10 Drawing Sheets

(56) References Cited

FOREIGN PATENT DOCUMENTS

| | | | | | |
|---|---|---|---|---|---|
| JP | 2010-090858 | A | | 4/2010 | |
| JP | WO2011/114894 | A1 | | 6/2013 | |
| JP | 2017-148484 | A | | 8/2017 | |
| JP | 2019-047859 | A | | 3/2019 | |
| JP | 2019-214997 | A | | 12/2019 | |
| JP | 2021-007676 | A | | 1/2021 | |
| KR | 20070103655 | A | * | 10/2007 | ..... E02D 3/08 |
| WO | 2017/099231 | A1 | | 6/2017 | |
| WO | 2019/225243 | A1 | | 11/2019 | |

* cited by examiner

GROUND IMPROVEMENT BODY

TECHNICAL FIELD

The present invention relates to a ground improvement body constructed under the foundation of a building.

BACKGROUND ART

As a ground improvement body to be constructed under the foundation of a building when the building is built on soft ground, there is a ground improvement body composed of a horizontal plate-shaped upper improvement body, and a lattice-shaped lower improvement body (e.g., refer to FIG. 2 and FIG. 3 of Patent Literature (PTL) 1, and FIG. 2 and FIG. 3 of PTL 2).

Such a ground improvement body composed of a horizontal plate-shaped upper improvement body and a lattice-shaped lower improvement body (hereinafter referred to as "ground improvement body including a lattice-shaped improvement body") is characterized by, for example, being capable of suppressing differential settlement while reducing the weight of the ground improvement body (improved volume), in comparison with a ground improvement body obtained by performing ground improvement to the entire ground under the foundation of a building.

CITATION LIST

Patent Literature

[PTL 1] Japanese Unexamined Patent Application Publication No. H8-302667

[PTL 2] Japanese Patent No. 3608568

[PTL 3] Japanese Unexamined Patent Application Publication No. H7-229153

SUMMARY OF THE INVENTION

Problems to be Solved by the Invention

It is known that column axial force caused by a dead load (long-term load) is generally small at an outer peripheral part and increases toward a center part (e.g., refer to FIG. 4 of PTL 3).

However, in the conventional ground improvement body including the lattice-shaped improvement body, a primary improved depth and width determined for the center part is applied to the periphery part.

Therefore, although the conventional ground improvement body including the lattice-shaped improvement body has the aforementioned characteristics, there is room for improvement in terms of further reducing the settlement and the improved volume of the ground improvement body.

It is an object of the present invention to provide a ground improvement body capable of further reducing the settlement and the improved volume, in comparison with the conventional ground improvement body including the lattice-shaped improvement body.

Solution to the Problems

The summary of the present invention is as follows.

[1] A ground improvement body including a horizontal plate-shaped upper improvement body and a lattice-shaped lower improvement body, the lower improvement body having a depth that is gradually increased from an outer peripheral part of the ground improvement body toward a center part of the ground improvement body, the lower improvement body including at least:

an outer periphery improvement body that supports columns and footings at the outer peripheral part of the ground improvement body;

an intermediate improvement body that supports columns and footings that are spaced apart from the columns and the footings supported by the outer periphery improvement body toward the center part of the ground improvement body;

a central improvement body that supports a column and a footing at the center part of the ground improvement body;

an outer-side connection improvement body that connects the footings supported by the outer periphery improvement body with the footings supported by the intermediate improvement body; and an inner-side connection improvement body that connects the footings supported by the intermediate improvement body with the footing supported by the central improvement body, wherein a depth D1 of the outer periphery improvement body, a depth D2 of the intermediate improvement body, and a depth D3 of the central improvement body satisfy D1<D2<D3, and a depth D12 of the outer-side connection improvement body and a depth D23 of the inner-side connection improvement body satisfy D12=D1 and D23=D3.

[2] The ground improvement body according to the above [1], in which a width W1 of the outer periphery improvement body, a width W2 of the intermediate improvement body, and a width W3 of the central improvement body satisfy W1<W2<W3, and a width W12 of the outer-side connection improvement body and a width W23 of the inner-side connection improvement body satisfy W12=W2 and W23=W3.

[3] A ground improvement body including a horizontal plate-shaped upper improvement body and a lattice-shaped lower improvement body, the lower improvement body having a depth that is gradually increased from an outer peripheral part of the ground improvement body toward a center part of the ground improvement body, the lower improvement body including at least:

an outer periphery improvement body that supports columns and footings at the outer peripheral part of the ground improvement body;

an intermediate improvement body that supports columns and footings that are spaced apart from the columns and the footings supported by the outer periphery improvement body toward the center part of the ground improvement body;

a central improvement body that supports a column and a footing at the center part of the ground improvement body;

an outer-side connection improvement body that connects the footings supported by the outer periphery improvement body with the footings supported by the intermediate improvement body; and an inner-side connection improvement body that connects the footings supported by the intermediate improvement body with the footing supported by the central improvement body, wherein a depth D1 of the outer periphery improvement body around each of the footings supported by the outer periphery improvement body, a depth D2 of the intermediate improvement body around each of the footings supported by the intermediate improvement body, and a depth D3 of the central improvement body around the footing supported by the central improvement body satisfy D1<D2<D3, a depth D10 of the outer periphery improvement body between adjacent footings supported by the outer periphery improvement body, and a depth D20 of the intermediate improvement body between adjacent footings supported by the intermediate improvement body satisfy D10=D1 and D20=D2, a width W1 of the outer periphery improvement body around each of the footings supported by the outer periphery improvement body, a width W2 of the intermediate improvement body around each of the footings supported by the intermediate improvement body, and a width W3 of the central improvement body around the footing supported by the central improvement body satisfy W1<W2<W3, a width W10 of the outer periphery improvement body between adjacent footings supported by the outer periphery improvement body satisfies W10<W1, a width W20 of the intermediate improvement body between adjacent footings supported by the intermediate improvement body satisfies W20<W2, a width W12 of the outer-side connection improvement body satisfies W12<W1, and a width W23 of the inner-side connection improvement body satisfies W23<W2.

[4] The ground improvement body according to the above [3], in which

W10=W20=W12=W23 is satisfied.

[5] A ground improvement body including a horizontal plate-shaped upper improvement body and a lattice-shaped lower improvement body, the lower improvement body including at least:

an outer periphery improvement body that supports columns and footings at the outer peripheral part of the ground improvement body;

an intermediate improvement body that supports columns and footings that are spaced apart from the columns and the footings supported by the outer periphery improvement body toward the center part of the ground improvement body;

a central improvement body that supports a column and a footing of the center part of the ground improvement body;

an outer-side connection improvement body that connects the footings supported by the outer periphery improvement body with the footings supported by the intermediate improvement body; and an inner-side connection improvement body that connects the footings supported by the intermediate improvement body with the footing supported by the central improvement body, wherein a depth D1 of the outer periphery improvement body around each of the footings supported by the outer periphery improvement body, a depth D2 of the intermediate improvement body around each of the footings supported by the intermediate improvement body, and a depth D3 of the central improvement body around the footing supported by the central improvement body satisfy D1<D2<D3, a depth D10 of the outer periphery improvement body between adjacent footings supported by the outer periphery improvement body, and a depth D20 of the intermediate improvement body between adjacent footings supported by the intermediate improvement body satisfy D10=D1, D20=D23, a depth D12 of the outer-side connection improvement body and a depth D23 of the inner-side connection improvement body satisfy D12=D1 and D12<D23<D2, a width W1 of the outer periphery improvement body around the each of footings supported by the outer periphery improvement body, a width W2 of the intermediate improvement body around each of the footings supported by the intermediate improvement body, and a width W3 of the central improvement body around the footing supported by the central improvement body satisfy W1<W2<W3, a width W10 of the outer periphery improvement body between adjacent footings supported by the outer periphery improvement body satisfies W10<W1, a width W20 of the intermediate improvement body between adjacent footings supported by the intermediate improvement body satisfies W20<W2, a width W12 of the outer-side connection improvement body satisfies W12<W1, and a width W23 of the inner-side connection improvement body satisfies W23<W2.

[6] The ground improvement body according to claim 5, in which

W10=W20=W12=W23 is satisfied.

Advantageous Effects of the Invention

According to a ground improvement body of the present invention, the ground contact pressure of the ground improvement body is balanced between its outer peripheral part and center part. Thus, as compared to a conventional ground improvement body including a lattice-shaped improvement body, absolute settlement can be suppressed, and a relative settlement can be reduced, whereby differential settlement can be alleviated. Moreover, the volume of the ground improvement body can be reduced, thereby reducing construction cost.

DESCRIPTION OF EMBODIMENTS

Figure 1:
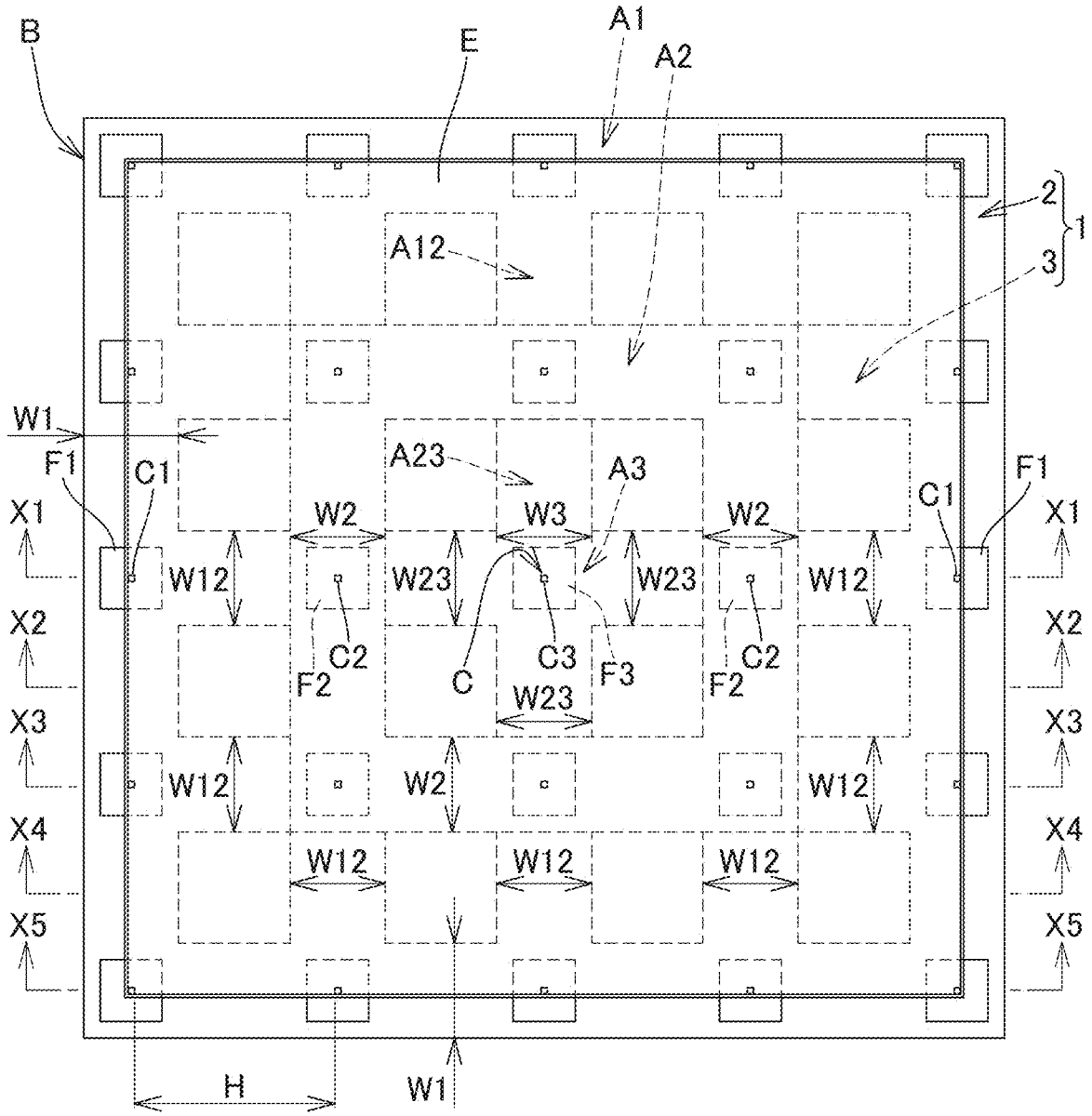
FIG. 1 is a plan view showing an example of a foundation structure of a building including a ground improvement body according to a first example of an embodiment of the present invention.
Figure 2A:
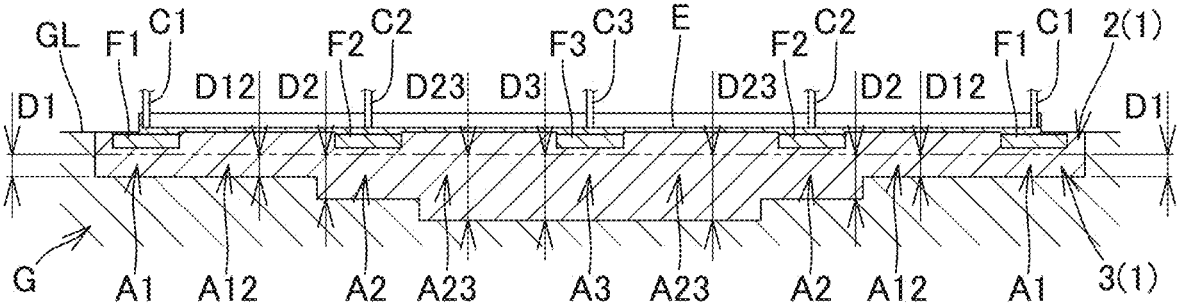
FIG. 2A is a cross-sectional view along arrows X1-X1 in FIG. 1.
Figure 2B:
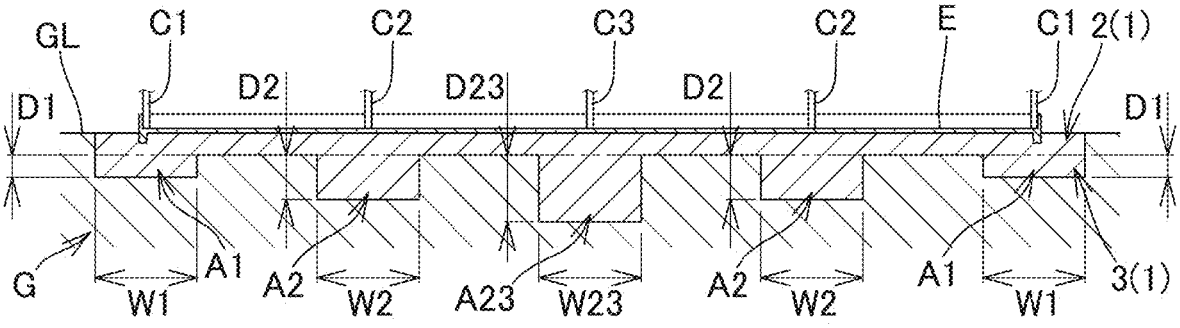
FIG. 2B is a cross-sectional view along arrows X2-X2 in FIG. 1.
Figure 2C:
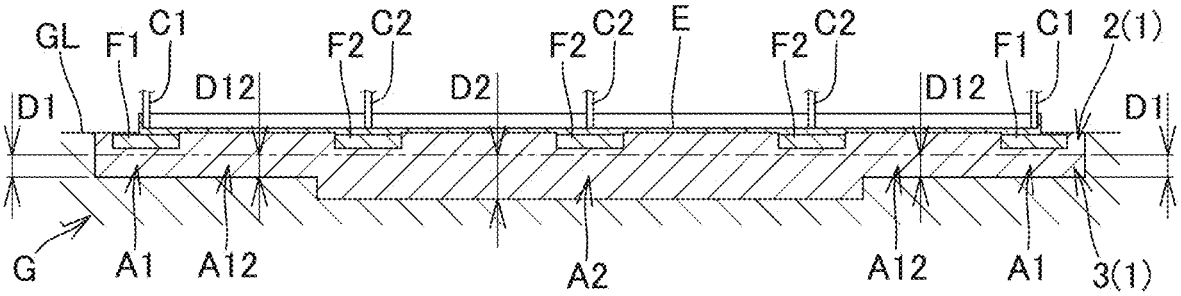
FIG. 2C is a cross-sectional view along arrows X3-X3 in FIG. 1.
Figure 2D:
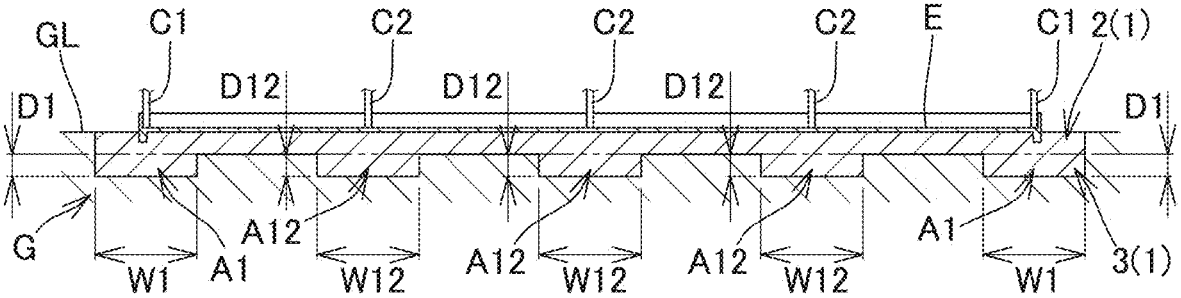
FIG. 2D is a cross-sectional view along arrows X4-X4 in FIG. 1.
Figure 2E:
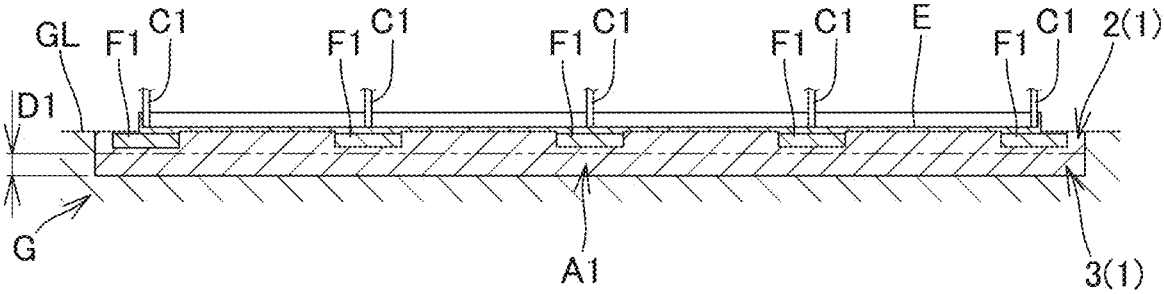
FIG. 2E is a cross-sectional view along arrows X5-X5 in FIG. 1.

Hereinafter, an embodiment of the present invention will be described with reference to the drawings.

The structure of a ground improvement body 1 and a construction method therefor will be described by representatively referring to the plan view of FIG. 1 and the cross-sectional views of FIG. 2A to FIG. 2E.

<Structure of Ground Improvement Body>

The ground improvement body 1 is composed of a horizontal plate-shaped upper improvement body 2 and a lattice-shaped lower improvement body 3.

<Construction Method for Ground Improvement Body>

(Dig-Down Step)

First, a surface-layer ground G below a ground surface GL is dug into a desired shape by, for example, plowing using a backhoe.

(Primary Improvement Step)

Next, the ground is excavated into the shape of the lower improvement body 3 by using, for example, a backhoe to which a mixing fork is mounted as an attachment. Then, mixing and stirring are performed while a solidification material such as a cement-based solidification material is added and mixed, and compaction is performed by a heavy machine and a roller, etc., to form the lower improvement body 3.

(Secondary Improvement Step)

Next, the soil having been dug out in the dig-down step is backfilled to the upper side of the lower improvement body 3 by using a backhoe or the like. Then, the surface-layer ground G is excavated from the ground surface GL into the shape of the upper improvement body 2 by using, for example, a backhoe to which a mixing fork is mounted as an attachment. Then, mixing and stirring are performed while a solidification material is added and mixed, and compaction is performed by a heavy machine and a roller, etc., to form the upper improvement body 2.

<Construction of Columns, Footings, Etc>

After construction of the ground improvement body 1, footings (concrete foundations under columns), columns, and the like are constructed. That is, an upper part of the upper improvement body 2 above intersections of the lattice-shaped lower improvement body 3 shown in the plan view of FIG. 1 is excavated into a desired shape, footings F1, F2, F3 are placed, columns C1, C2, C3 are arranged, and floor concrete E is placed.

<Description of Embodiments>

In the embodiment described below, regarding first to third examples, the depth of the lower improvement body 3 is gradually increased from an outer peripheral part B of the ground improvement body 1 toward a center part C of the ground improvement body 1. In a fourth example described below, the depth of the lower improvement body 3 tends to be gradually increased from the outer peripheral part B of the ground improvement body 1 toward the center part C of the ground improvement body 1 as a whole, but the depths of some ground improvement bodies (an intermediate improvement body A2 between adjacent footings F2, F2 supported by the intermediate improvement body A2, and an inner-side connection improvement body A23) are reduced.

In the first example (FIG. 1, FIG. 2A to FIG. 2E), the depth of the lower improvement body 3 is gradually increased toward the center part C.

In the second example (FIG. 3, FIG. 4A to FIG. 4E), the width of the lower improvement body 3 is gradually increased toward the center part C so as to be reduced at the outer peripheral part B and increased at the center part C, in contrast with the first example.

In the third example (FIG. 5, FIG. 6A to FIG. 6E), a width W10 of an outer periphery improvement body A1 between adjacent footings F1, F1 supported by the outer periphery improvement body A1 is smaller than a width W1 of the outer periphery improvement body A1 around the footing F1 supported by the outer periphery improvement body A1 (W10<W1), a width W20 of the intermediate improvement body A2 between adjacent footings F2, F2 supported by the intermediate improvement body A2 is smaller than a width W2 of the intermediate improvement body A2 around the footing F2 supported by the intermediate improvement body A2 (W20<W2), a width W12 of an outer-side connection improvement body A12 is smaller than the width W1 (W12<W1), and a width W23 of an inner-side connection improvement body A23 is smaller than the width W2 (W23<W2), in contrast with those of the second example.

In a fourth example (FIG. 7, FIG. 8A to FIG. 8E), a depth D20 of the intermediate improvement body A2 between adjacent footings F2, F2 supported by the intermediate improvement body A2, and a depth D23 of the inner-side connection improvement body A23 are equal to or smaller than a predetermined value, and for example, smaller than the depth D2 of the intermediate improvement body A2 (D20<D2, D23<D2), in contrast with those of the third example.

In the examples of the plan views of FIG. 1, FIG. 3, FIG. 5, and FIG. 7 described below, the ground improvement body 1 is configured in a four-fold rotational symmetry, that is, the ground improvement body 1 overlaps when being rotated by 90 degrees around a column C3 in the center part C of the ground improvement body 1. However, the ground improvement body 1 is not limited to such a configuration.

First Example

In the first example shown in the plan view of FIG. 1 and the cross-sectional views of FIG. 2A to FIG. 2E, the lower improvement body 3 includes an outer periphery improvement body A1, an intermediate improvement body A2, a central improvement body A3, an outer-side connection improvement body A12, and an inner-side connection improvement body A23.

The outer periphery improvement body A1 supports columns C1 and footings F1 of the outer peripheral part B of the ground improvement body 1. The intermediate improvement body A2 supports columns C2 and footings F2, which are spaced apart from the columns C1 and the footings F1 supported by the outer periphery improvement body A1 toward the center part C of the ground improvement body 1. The central improvement body A3 supports a column C3 and a footing F3 at the center part C of the ground improvement body 1.

The outer-side connection improvement body A12 connects the footings F1 supported by the outer periphery improvement body A1 with the footings F2 supported by the intermediate improvement body A2. The inner-side connection improvement body A23 connects the footings F2 supported by the intermediate improvement body A2 with the footing F3 supported by the central improvement body A3.

The depth D1 of the outer periphery improvement body A1, the depth D2 of the intermediate improvement body A2, and the depth D3 of the central improvement body A3 satisfy D1<D2<D3. The depth D12 of the outer-side connection improvement body A12 and the depth D23 of the inner-side connection improvement body A23 satisfy D12=D1 and D23=D3.

The width W1 of the outer periphery improvement body A1, the width W2 of the intermediate improvement body A2, the width W3 of the central improvement body A3, the width W12 of the outer-side connection improvement body A12, and the width W23 of the inner-side connection improvement body A23 are equal to each other, that is, satisfy W1=W2=W3=W12=W23.

Second Example

Figure 3:
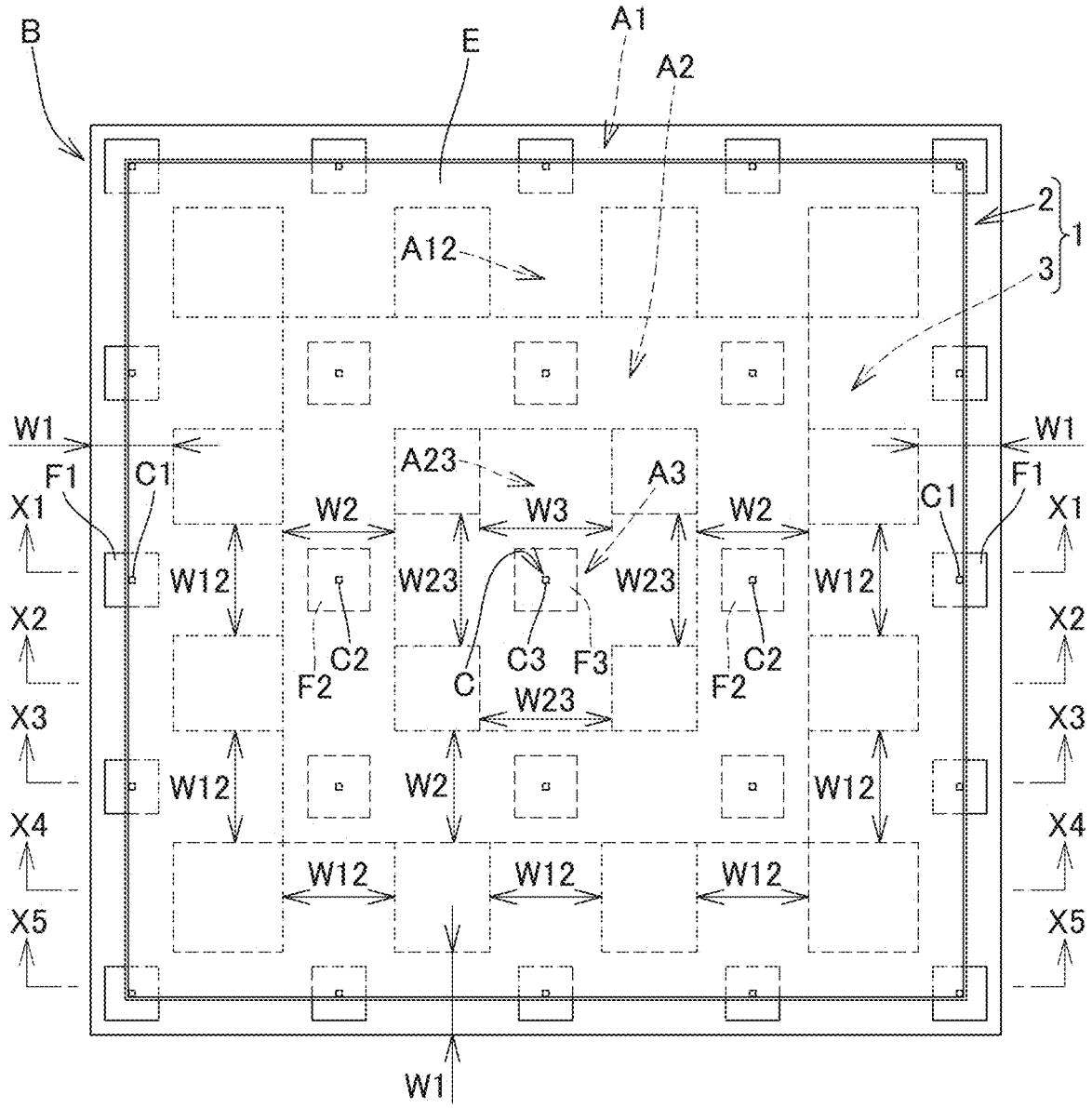
FIG. 3 is a plan view showing an example of a foundation structure of a building including a ground improvement body according to a second example of the embodiment of the present invention.
Figure 4A:
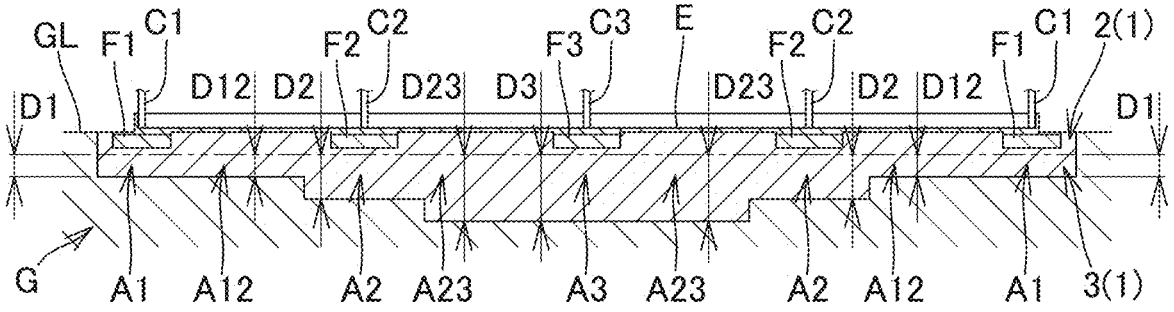
FIG. 4A is a cross-sectional view along arrows X1-X1 in FIG. 3.
Figure 4B:
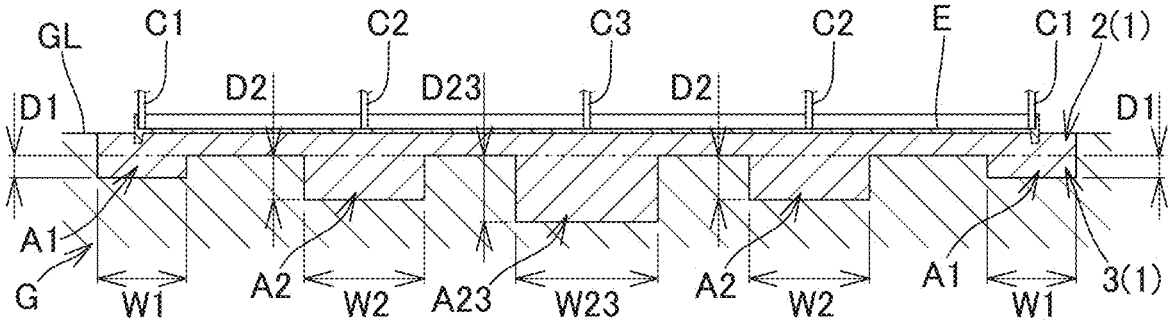
FIG. 4B is a cross-sectional view along arrows X2-X2 in FIG. 3.
Figure 4C:
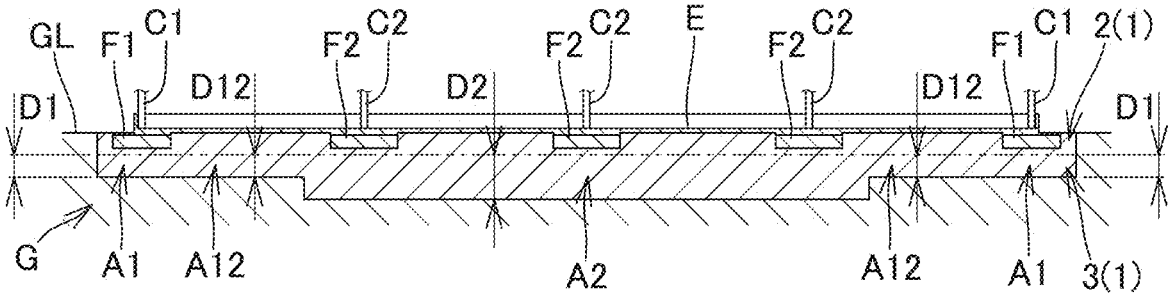
FIG. 4C is a cross-sectional view along arrows X3-X3 in FIG. 3.
Figure 4D:
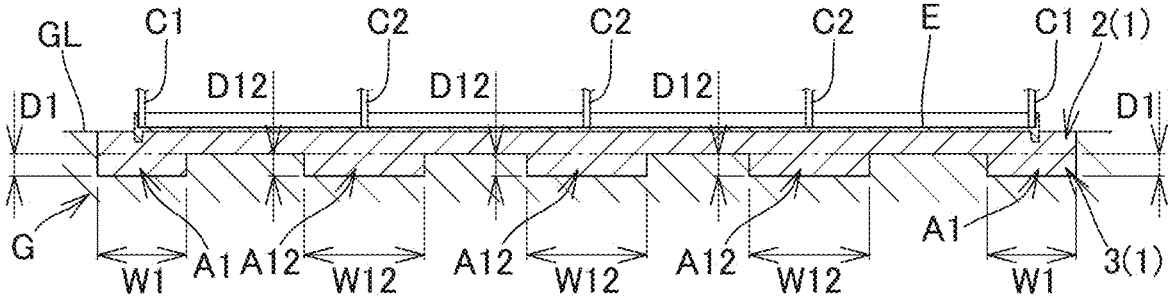
FIG. 4D is a cross-sectional view along arrows X4-X4 in FIG. 3.
Figure 4E:
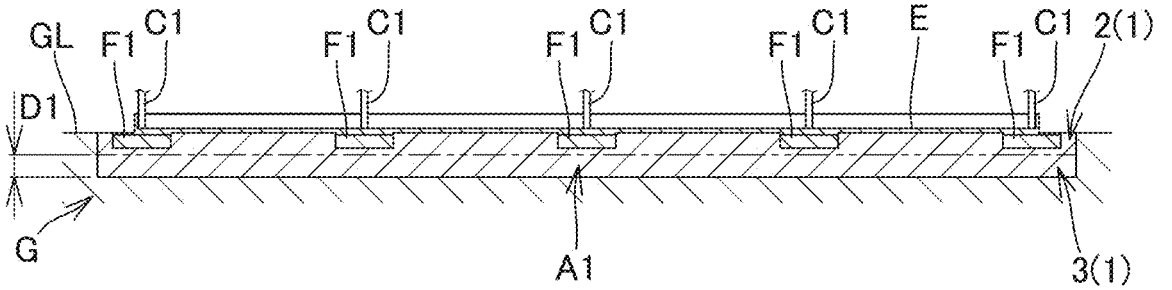
FIG. 4E is a cross-sectional view along arrows X5-X5 in FIG. 3.

The lower improvement body 3 according to the second example shown in the plan view of FIG. 3 and the cross-sectional views of FIG. 4A to FIG. 4E is different from the first example in that, as described above, the width of the lower improvement body 3 is gradually increased toward the center part C so as to be reduced at the outer peripheral part B and increased at the center part C, in contrast with that of the first example.

That is, the width W1 of the outer periphery improvement body A1, the width W2 of the intermediate improvement body A2, and the width W3 of the central improvement body A3 satisfy W1<W2<W3, and the width W12 of the outer-side connection improvement body A12 and the width W23 of the inner-side connection improvement body A23 satisfy W12=W2 and W23=W3.

Third Example

Figure 5:
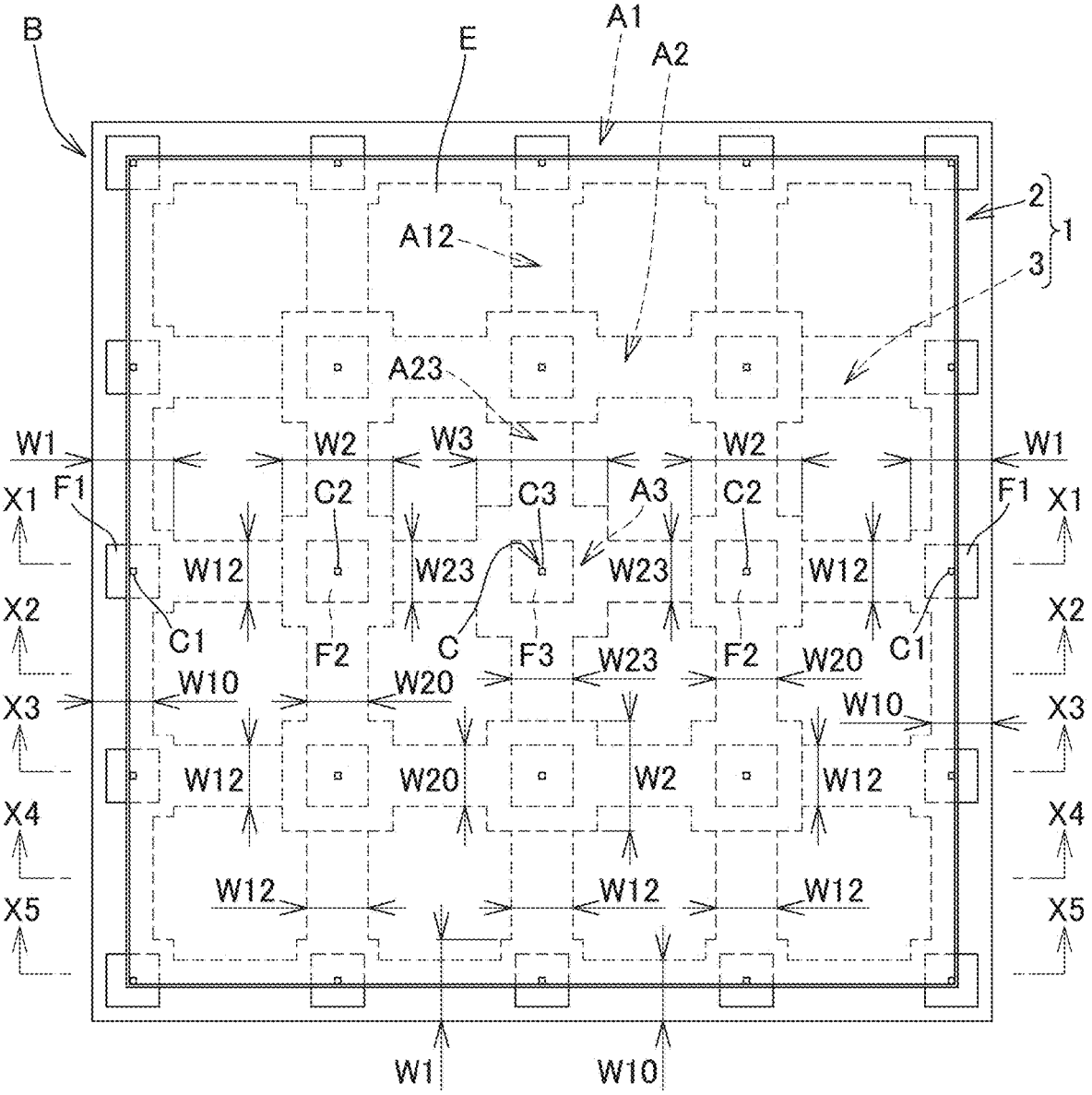
FIG. 5 is a plan view showing an example of a foundation structure of a building including a ground improvement body according to a third example of the embodiment of the present invention.
Figure 6A:
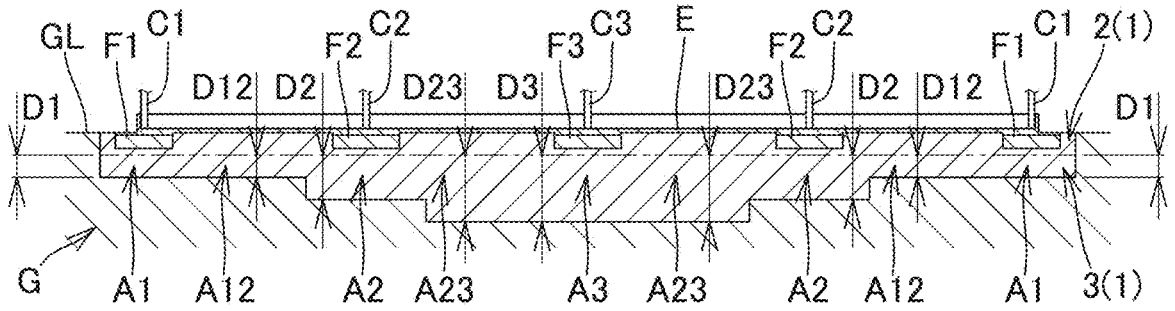
FIG. 6A is a cross-sectional view along arrows X1-X1 in FIG. 5.
Figure 6B:
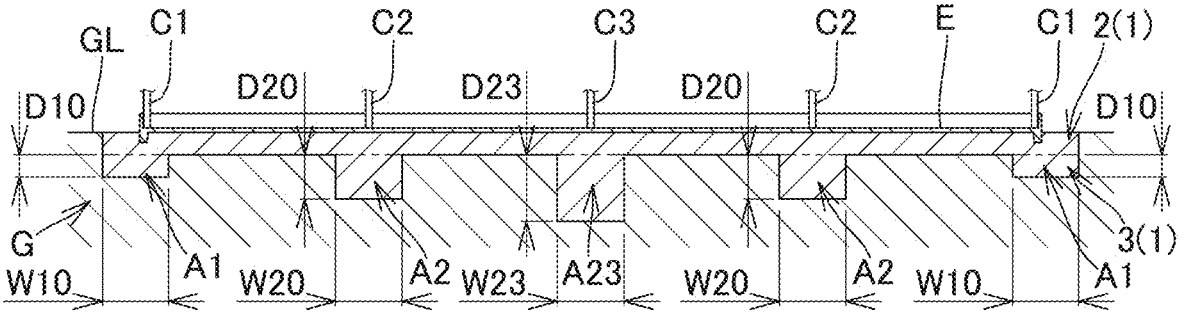
FIG. 6B is a cross-sectional view along arrows X2-X2 in FIG. 5.
Figure 6C:
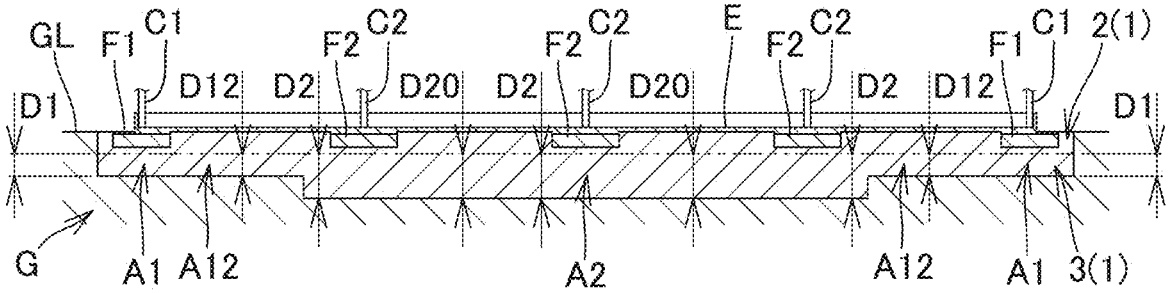
FIG. 6C is a cross-sectional view along arrows X3-X3 in FIG. 5.
Figure 6D:
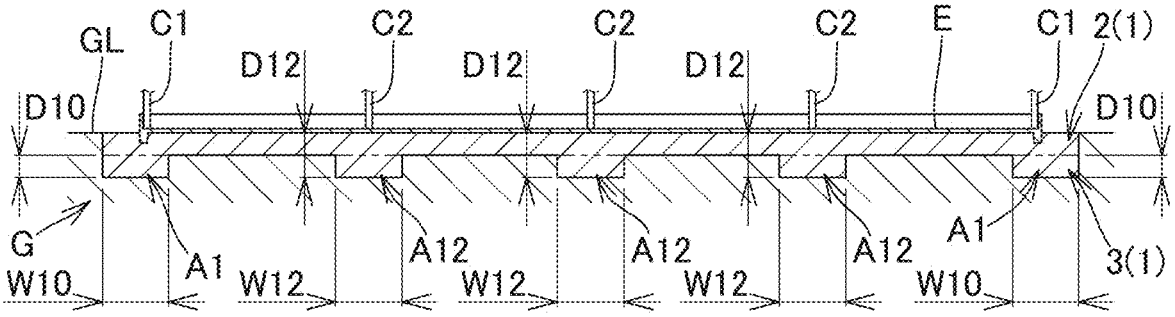
FIG. 6D is a cross-sectional view along arrows X4-X4 in FIG. 5.
Figure 6E:
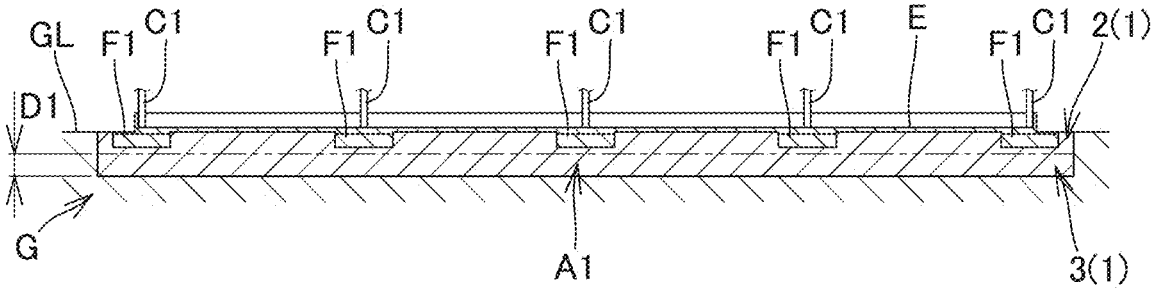
FIG. 6E is a cross-sectional view along arrows X5-X5 in FIG. 5.

The lower improvement body 3 according to the third example shown in the plan view of FIG. 5 and the cross-sectional views of FIG. 6A to FIG. 6E is different from the second example in that, as described above, the width W10 of the outer periphery improvement body A1 between adjacent footings F1, F1 supported by the outer periphery improvement body A1, the width W20 of the intermediate improvement body A2 between adjacent footings F2, F2 supported by the intermediate improvement body A2, the width W12 of the outer-side connection improvement body A12, and the width W23 of the inner-side connection improvement body A23 are reduced, in contrast with those of the second example.

That is, the width W1 of the outer periphery improvement body A1 around the footing F1 supported by the outer periphery improvement body A1, the width W2 of the intermediate improvement body A2 around the footing F2 supported by the intermediate improvement body A2, and the width W3 of the central improvement body A3 around the footing F3 supported by the central improvement body A3 satisfy W1<W2<W3, and satisfy W10<W1, W20<W2, W12<W1, and W23<W2. In the example shown in FIG. 5, W10=W20=W12=W23.

Moreover, as shown in FIG. 6A to FIG. 6E, the depth D1 of the outer periphery improvement body around the footing F1 supported by the outer periphery improvement body A1, the depth D2 of the intermediate improvement body A2 around the footing F2 supported by the intermediate improvement body A2, and the depth D3 of the central improvement body A3 around the footing F3 supported by the central improvement body A3 satisfy D1<D2<D3. The depth D10 of the outer periphery improvement body A1 between adjacent footings F1, F1 supported by the outer periphery improvement body A1, and the depth D20 of the intermediate improvement body A2 between adjacent footings F2, F2 supported by the intermediate improvement body A2 satisfy D10=D1 and D20=D2.

Fourth Example

Figure 7:
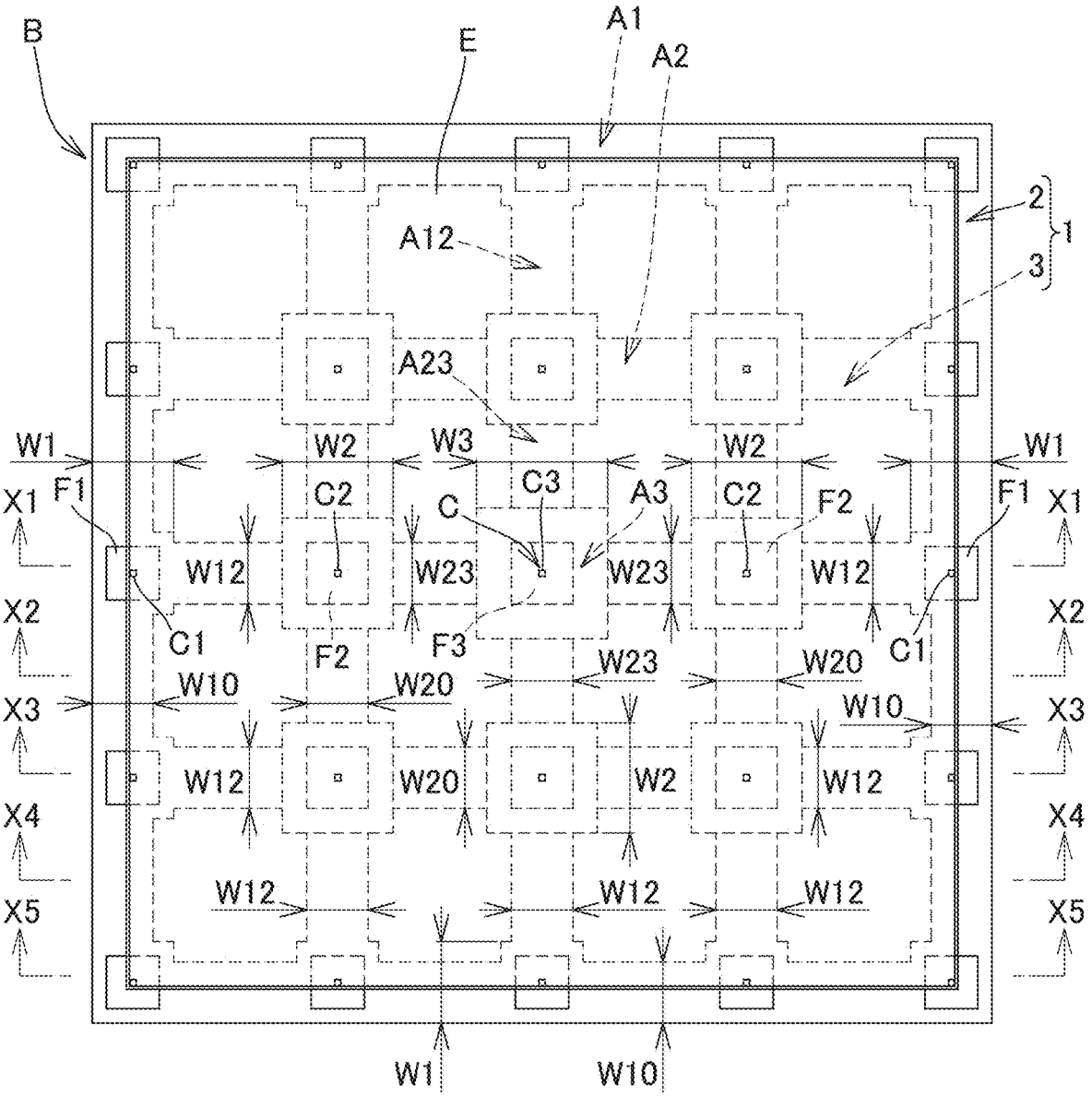
FIG. 7 is a plan view showing an example of a foundation structure of a building including a ground improvement body according to a fourth example of the embodiment of the present invention.
Figure 8A:
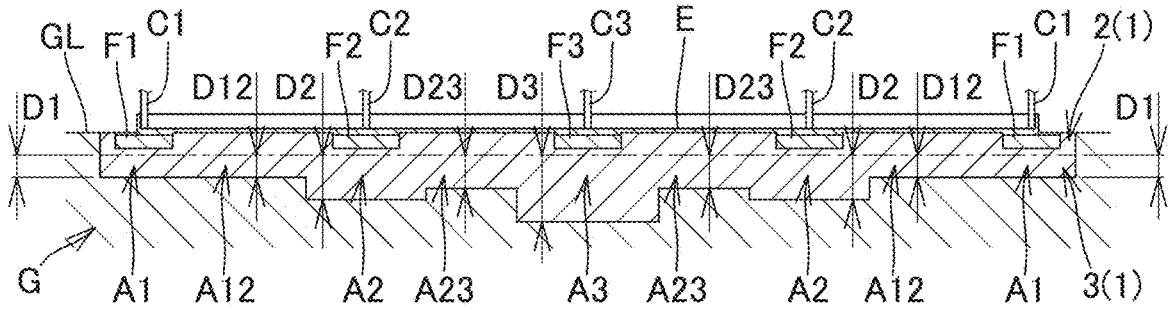
FIG. 8A is a cross-sectional view along arrows X1-X1 in FIG. 7.
Figure 8B:
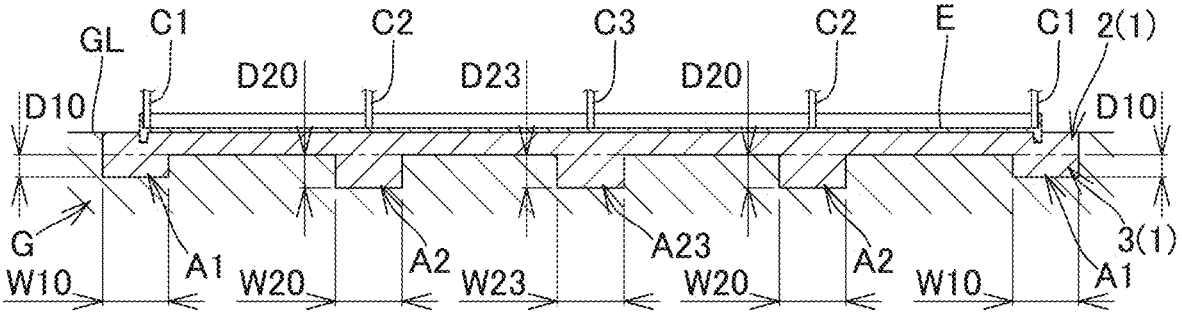
FIG. 8B is a cross-sectional view along arrows X2-X2 in FIG. 7.
Figure 8C:
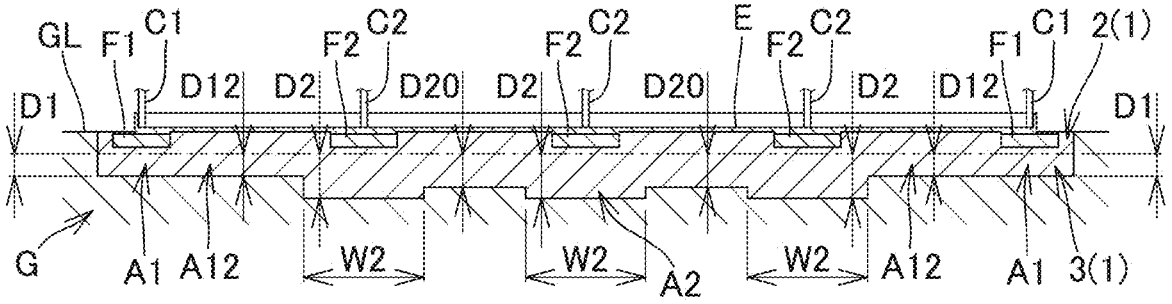
FIG. 8C is a cross-sectional view along arrows X3-X3 in FIG. 7.
Figure 8D:
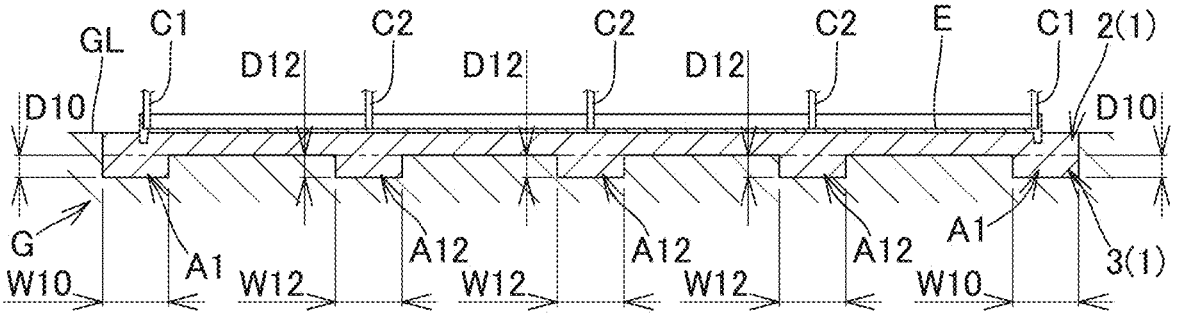
FIG. 8D is a cross-sectional view along arrows X4-X4 in FIG. 7.
Figure 8E:
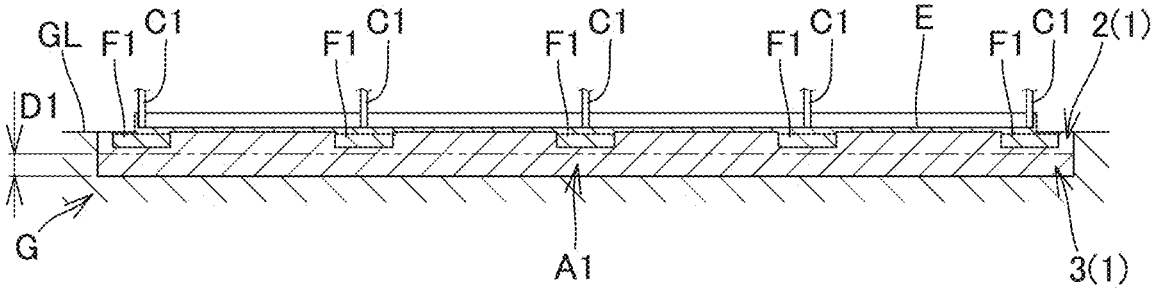
FIG. 8E is a cross-sectional view along arrows X5-X5 in FIG. 7.

The lower improvement body 3 according to the fourth example shown in the plan view of FIG. 7 and the cross-sectional views of FIG. 8A to FIG. 8E is different from the third example in that, as described above, the depth D20 of the intermediate improvement body A2 between adjacent footings F2, F2 supported by the intermediate improvement body A2, and the depth D23 of the inner-side connection improvement body A23 are reduced, in contrast with those of the third example.

That is, the depth D1 of the outer periphery improvement body around the footing F1 supported by the outer periphery improvement body A1, the depth D2 of the intermediate improvement body F2 around the footing F2 supported by the intermediate improvement body A2, and the depth D3 of the central improvement body A3 around the footing F3 supported by the central improvement body A3 satisfy D1<D2<D3. The depth D10 of the outer periphery improvement body A1 between adjacent footings F1, F1 supported by the outer periphery improvement body A1, and the depth D20 of the intermediate improvement body A2 between adjacent footings F2, F2 supported by the intermediate improvement body A2 satisfy D10=D1 and D20=D23. The depth D12 of the outer-side connection improvement body and the depth D23 of the inner-side connection improvement body satisfy D12=D1 and D12<D23<D2.

In the ground improvement body 1 of the present invention, for example, the depth, or the depth and width, of the lower improvement body 3 is reduced toward the outer peripheral part B, in contrast with the depth and width (primary improved depth and width) of the lower improvement body 3 which are determined at the center part C during designing, thereby balancing the ground contact pressure of the ground improvement body between the center part C and the outer peripheral part B. Thus, as compared to the conventional ground improvement body including the lattice-shaped improvement body, the absolute settlement is suppressed, and the relative settlement is reduced, whereby differential settlement can be alleviated. Moreover, the volume of the ground improvement body can be reduced, thereby reducing construction cost.

<Numerical Analysis>

Next, numerical analysis performed to confirm the effects of the present invention will be described.

(Analysis Method)

Assuming that the surface layer ground G is a 20 m deep clay layer, numerical analysis is performed using soil finite element method (FEM) analysis software (PLAXIS). Evaluation items are "ground contact pressure under lower improvement body 3", "maximum absolute settlement", "maximum relative settlement", and "volume of ground improvement body 1".

Assuming that the settlement in the state where all loads such as buildings and footings are not mounted is 0, the "absolute settlement" is the settlement due to the loads. The "maximum absolute settlement" is a maximum value of the absolute settlement in the site.

Assuming that, after settlement due to the loads, the smallest absolute settlement at a point among points in the site is 0, the "relative settlement" is the settlement at another point. The "maximum relative settlement" is a maximum value of the relative settlement in the site.

EXAMPLES AND COMPARATIVE EXAMPLES

Figure 9:
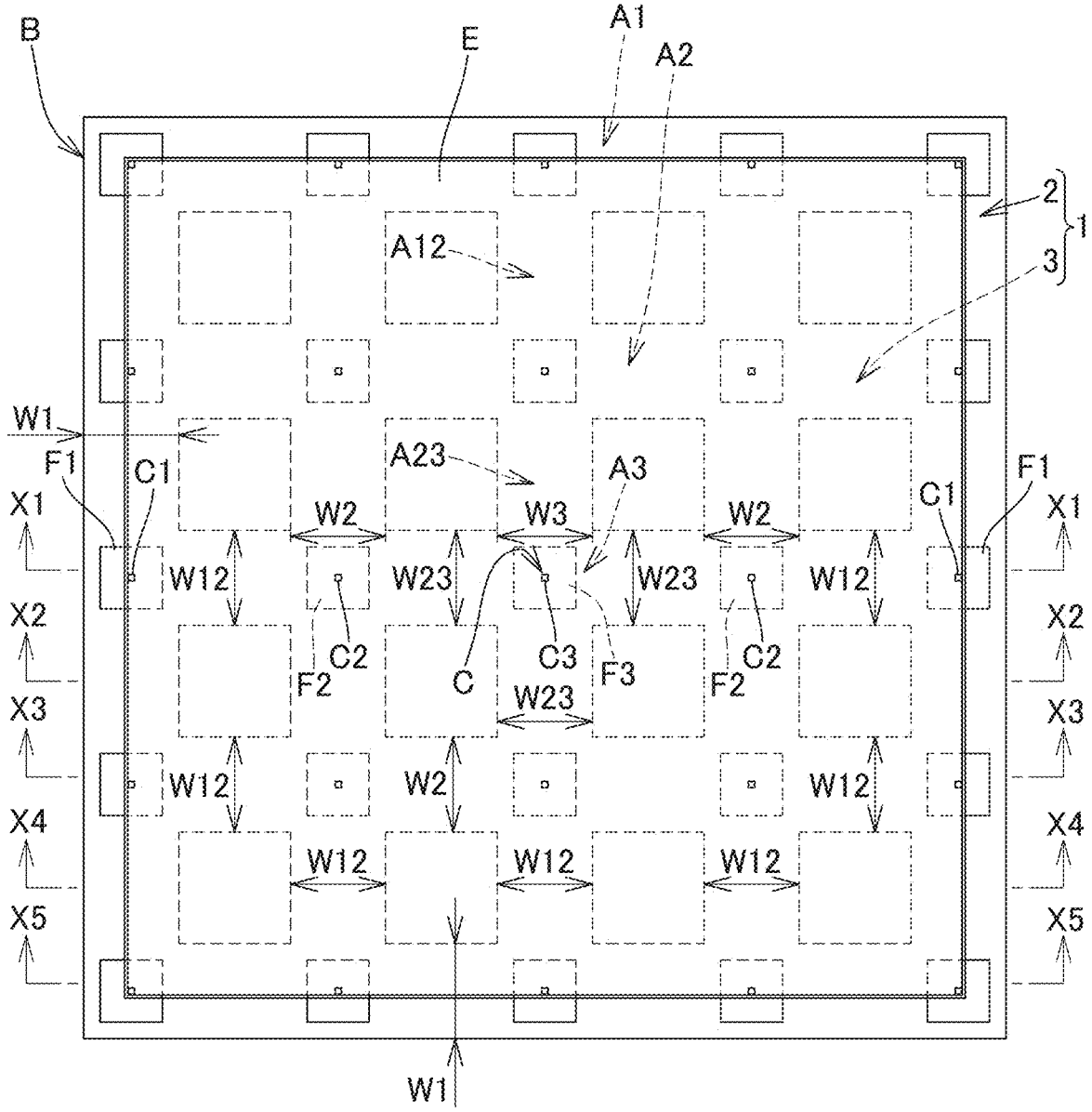
FIG. 9 is a plan view showing an example of a foundation structure of a building including a ground improvement body according to a comparative example.
Figure 10A:
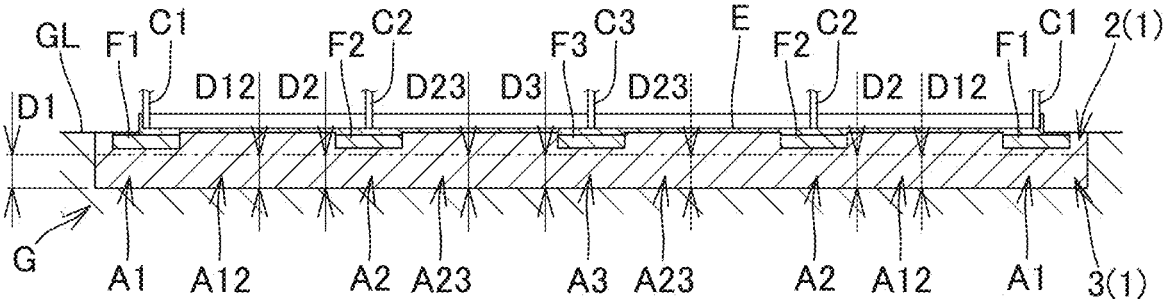
FIG. 10A is a cross-sectional view along arrows X1-X1 in FIG. 9.
Figure 10B:
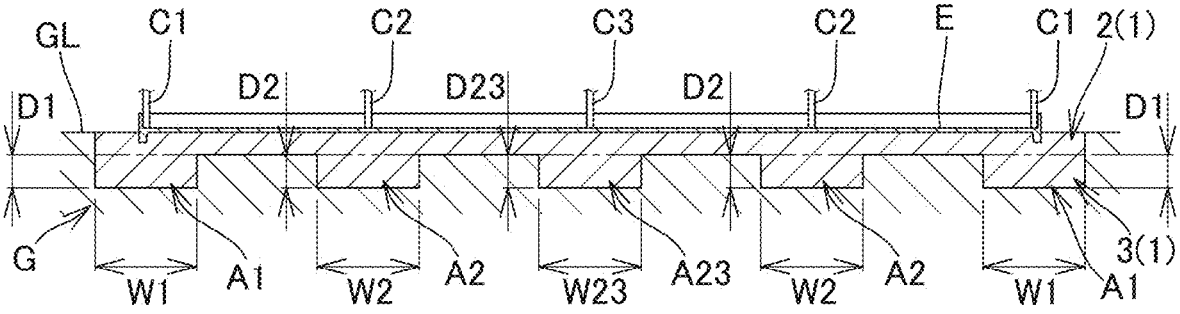
FIG. 10B is a cross-sectional view along arrows X2-X2 in FIG. 9.
Figure 10C:
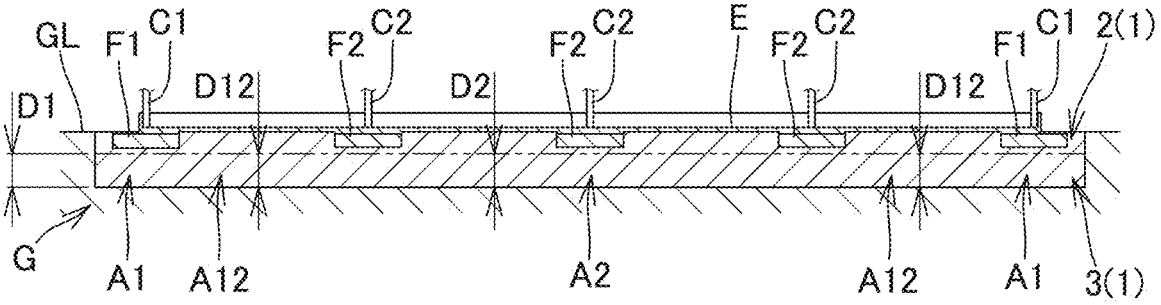
FIG. 10C is a cross-sectional view along arrows X3-X3 in FIG. 9.
Figure 10D:
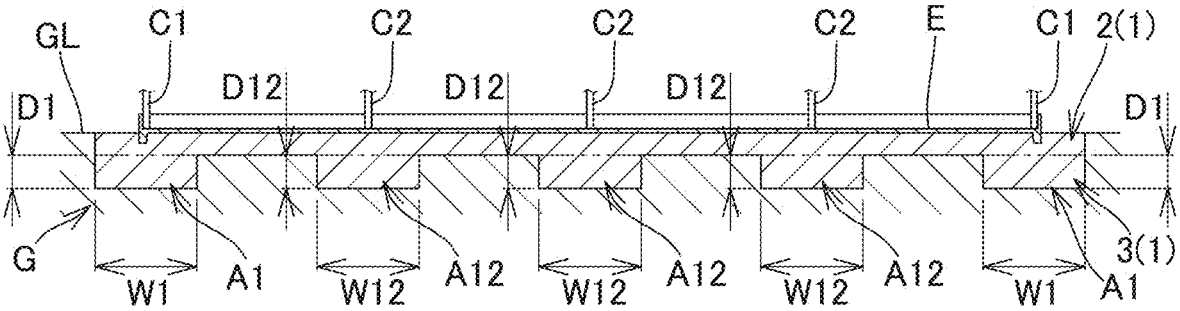
FIG. 10D is a cross-sectional view along arrows X4-X4 in FIG. 9.
Figure 10E:
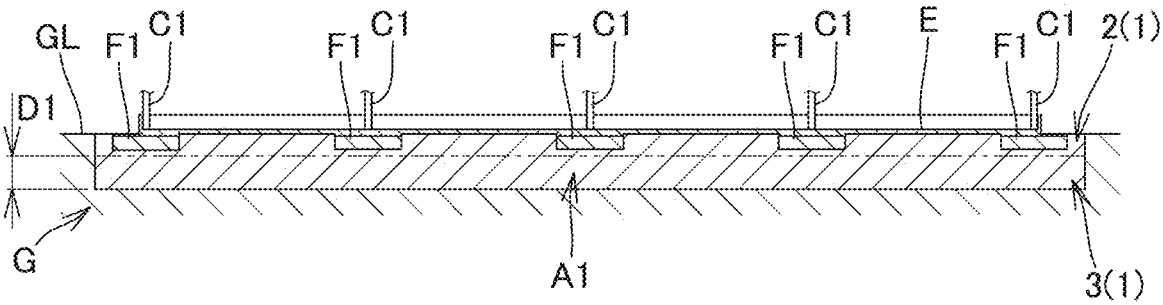
FIG. 10E is a cross-sectional view along arrows X5-X5 in FIG. 9.

Examples include the first to fourth examples. A comparative example is shown in the plan view of FIG. 9 and the cross-sectional views of FIG. 10A to FIG. 10E. That is, in the comparative example, the lattice-shaped lower improvement body 3 has a uniform width (W1=W2=W3=W12=W23) and a uniform thickness (D1=D2=D3=D12=D23).

As for the size of the ground improvement body 1, for example, the distance between adjacent columns, which is denoted by "H" in FIG. 1, is 10 m, the thickness of the upper improvement body 2 is 1 m, and the thickness and the width of the lower improvement body 3 are as described in the following (1) to (5) for the examples and the comparative example. The thickness of the floor concrete E is 0.2 m.

(1) First Example (FIG. 1, FIG. 2A to FIG. 2E)

D1=D12=1 m, D2=2 m, D3=D23=3 m
W1=W2=W3=W12=W23=4.6 m (2) Second Example (FIG. 3, FIG. 4A to FIG. 4E)

D1=D12=1 m, D2=2 m, D3=D23=3 m
W1=4 m, W2=W12=5.4 m, W3=W23=6.4 m (3) Third Example (FIG. 5, FIG. 6A to FIG. 6E)

D1=D10=D12=1 m, D2=D20=2 m, D3=D23=3 m
W1=4 m, W2=5.4 m, W3=6.4 m
W10=W20=W12=W23=3 m (4) Fourth Example (FIG. 7, FIG. 8A to FIG. 8E)

D1=D10=D12=1 m, D2=2 m, D3=3 m
D20=D23=1.5 m (5) Comparative Example (FIG. 9, FIG. 10A to FIG. 10E)

D1=D2=D3=D12=D23=1.5 m
W1=W2=W3=W12=W23=4.6 m (Load Condition)

The ground contact pressure under the ground improvement body 3 can be divided into: a ground contact pressure due to a point load (i.e., column axial force: self-weight of building+live loads of second and higher floors); and a ground contact pressure due to a surface load (live load of first floor+self-weight of floor concrete+self-weight of footings+self-weight of ground improvement body).

The ground contact pressure due to the point load under the ground improvement body 3 is great because it concentrates directly under the ground improvement body 3, and has a significant influence on settlement. Meanwhile, the surface load is evenly applied over the entire site, and the ground contact pressure per unit area is small and equalized, in comparison with the column load. Therefore, the surface load has less influence on differential settlement than the column load.

The load in the analysis for obtaining the "ground contact pressure under lower improvement body 3" is only the "point load", in order to clarify a difference in ground contact pressure due to the point load having a significant influence on differential settlement. The point load in the analysis imitates a dead load (long-term load) that is actually applied and gradually increases from the outer peripheral part B toward the center part C. A point load applied to each of 16 columns C1 in the outer peripheral part B of the ground improvement body 1 is 200 kN, and a point load applied to each of nine columns C3 and C2 in the center part C and the intermediate part is 400 kN.

As for the loads in the analysis for obtaining the "maximum absolute settlement" and the "maximum relative settlement", the surface load is applied in addition to the "point load" described above. The surface load is self-weight of 24 $kN/m^3$ of footings F1, F2, F3, and self-weight of 17 $kN/m^3$ of the ground improvement body 1 are applied to the range of the floor concrete E, as a load based on the self-weight of the floor concrete E and the live load, a surface load of 14.8 $kN/m^2$.

(Analysis Result and Consideration)

Table 1 shows results of the analysis.

TABLE 1

| Comparative example/ Examples | Ground contact pressure under lower improvement body 3 (kPa) Center part C ←→ Outer peripheral part B: Under column C3 | Under column C2 | Under column C1 | Settlement: Max absolute (Comparative Example = 1) | Settlement: Max relative (Comparative Example = 1) | Volume of ground improvement body 1 (Comparative Example = 1) |
|---|---|---|---|---|---|---|
| Comparative example | 5.4 | 5.5 | 4.4 | 1 | 1 | 1 |
| First example | 5.1 | 5.1 | 4.5 | 0.90 | 0.81 | 0.96 |
| Second example | 4.6 | 5.3 | 5.9 | 0.89 | 0.78 | 0.99 |
| Third example | 5.4 | 4.9 | 5.3 | 0.92 | 0.84 | 0.85 |
| Fourth example | 5.5 | 5.5 | 5.4 | 0.93 | 0.85 | 0.82 |

According to the "ground contact pressure under lower improvement body 3" in Table 1, the ground contact pressures at the outer peripheral part B and the center part C of the first to fourth examples are balanced or reversed with respect to those of the comparative example. Since the settlement is substantially proportional to the ground contact pressure, the "settlement" in Table 1 indicates that the absolute settlement is more suppressed and the relative settlement is more reduced in the first to fourth examples than in the comparative example, and thus differential settlement can be alleviated.

According to the "volume of ground improvement body 1" in Table 1, the volume of the ground improvement body 1 is reduced by 4% in the first example, 1% in the second example, 15% in the third example, and 18% in the fourth example with respect to that of the comparative example. Thus, construction cost can be reduced.

In particular, as in the third example and the fourth example, the volume (weight) of the ground improvement body 1 can be significantly reduced while alleviating differential settlement, by reducing the width W10 of the outer periphery improvement body A1 between the adjacent footings F1, F1 supported by the outer periphery improvement body A1, the width W20 of the intermediate improvement body A2 between the adjacent footings F2, F2 supported by the intermediate improvement body A2, the width W12 of the outer-side connection improvement body A12, and the width W23 of the inner-side connection improvement body A23. Therefore, the effect of reducing construction cost is enhanced.

Since the sizes of the footings F1, F2, F3 are determined based on the stress from the building and the ground strengths of the improved ground and the original ground, the width W1 of the outer periphery improvement body A1 around the footing F1, the width W2 of the intermediate improvement body A2 around the footing F2, and the width W3 of the central improvement body A3 around the footing F3 are limited and cannot be made smaller than required sizes. Therefore, it is possible to realize a significant reduction in the volume (weight) of the ground improvement body 1 while alleviating differential settlement, by reducing, in particular, the width W10 of the outer periphery improvement body A1 between the adjacent footings F1, F1, the width W20 of the intermediate improvement body A2 between the adjacent footings F2, F2, the width W12 of the outer-side connection improvement body A12, and the width W23 of the inner-side connection improvement body A23 (W10<W1, W20<W2, W12<W1, W23<W2<W3), as in the third example and the fourth example.

In the conventional design and construction, the ground contact pressure due to the force acting on the center part is smaller than the ground strength (allowable value), as a standard, and the ground contact pressure is maximized within a range that satisfies the standard, thereby minimizing the footings and the ground volume to be improved. In contrast, in the present invention, the ground contact pressure due to the force acting on the center part is smaller than or equal to the ground contact pressure due to the force acting on the outer peripheral part which is smaller than the ground strength (allowable value) is applied as a standard, and design and construction is prioritized over suppression of differential settlement. That is, a purpose of the present invention is to increase each volume of the footings and the ground improvement until achieving suppression of differential settlement at the center part. However, since the volume of the ground to be improved at the center part is increased, the entire cost is increased. Therefore, the inventor of the present application expected the effect of offsetting an increase in cost or further reducing the cost while maintaining the effect of suppressing differential settlement, by reducing the improved volume between foundations, and proved the effect in this analysis.

The ground improvement body of the present invention provides the above effects, and therefore is suitably used as a ground improvement body to be constructed particularly under foundations of low-rise and large-area buildings such as factories, shopping centers, warehouses, and housing.

The above-described embodiment is in all aspects illustrative and not restrictive. Various modifications and variations can be devised without departing from the scope of the invention.

DESCRIPTION OF THE REFERENCE CHARACTERS

1 ground improvement body
2 upper improvement body
3 lower improvement body
A1 outer periphery improvement body
A2 intermediate improvement body
A3 central improvement body
A12 outer-side connection improvement body
A23 inner-side connection improvement body
B outer peripheral part of ground improvement body
C center part of ground improvement body
C1, C2, C3 column
D1 depth of outer periphery improvement body
D2 depth of intermediate improvement body
D3 depth of central improvement body D10 depth of outer periphery improvement body between adjacent footings supported by outer periphery improvement body D12 depth of outer-side connection improvement body D20 depth of intermediate improvement body between adjacent footings supported by intermediate improvement body D23 depth of inner-side connection improvement body E floor concrete F1, F2, F3 footing G surface layer ground GL ground surface H distance between adjacent columns W1 width of outer periphery improvement body, width of outer periphery improvement body around footing supported by outer periphery improvement body W2 width of intermediate improvement body, width of intermediate improvement body around footing supported by intermediate improvement body W3 width of central improvement body, width of central improvement body around footing supported by central improvement body W10 width of outer periphery improvement body between adjacent footings supported by outer periphery improvement body W12 width of outer-side connection improvement body W20 width of intermediate improvement body between adjacent footings supported by intermediate improvement body W23 width of inner-side connection improvement body

The invention claimed is:

1. A ground improvement body comprising a horizontal plate-shaped upper improvement body and a lattice-shaped lower improvement body, the lower improvement body having a depth that is gradually increased from an outer peripheral part of the ground improvement body toward a center part of the ground improvement body, the lower improvement body including at least:

an outer periphery improvement body that supports columns and footings at the outer peripheral part of the ground improvement body;

an intermediate improvement body that supports columns and footings that are spaced apart from the columns and the footings supported by the outer periphery improvement body toward the center part of the ground improvement body;

a central improvement body that supports a column and a footing at the center part of the ground improvement body;

an outer-side connection improvement body that connects the footings supported by the outer periphery improvement body with the footings supported by the intermediate improvement body; and an inner-side connection improvement body that connects the footings supported by the intermediate improvement body with the footing supported by the central improvement body, wherein a depth D1 of the outer periphery improvement body, a depth D2 of the intermediate improvement body, and a depth D3 of the central improvement body satisfy D1<D2<D3, and a depth D12 of the outer-side connection improvement body and a depth D23 of the inner-side connection improvement body satisfy D12=D1 and D23=D3.

2. The ground improvement body according to claim 1, wherein a width W1 of the outer periphery improvement body, a width W2 of the intermediate improvement body, and a width W3 of the central improvement body satisfy W1<W2<W3, and a width W12 of the outer-side connection improvement body and a width W23 of the inner-side connection improvement body satisfy W12=W2 and W23=W3.

3. A ground improvement body comprising a horizontal plate-shaped upper improvement body and a lattice-shaped lower improvement body, the lower improvement body having a depth that is gradually increased from an outer peripheral part of the ground improvement body toward a center part of the ground improvement body, the lower improvement body including at least:

an outer periphery improvement body that supports columns and footings at the outer peripheral part of the ground improvement body;

an intermediate improvement body that supports columns and footings that are spaced apart from the columns and the footings supported by the outer periphery improvement body toward the center part of the ground improvement body;

a central improvement body that supports a column and a footing at the center part of the ground improvement body;

an outer-side connection improvement body that connects the footings supported by the outer periphery improvement body with the footings supported by the intermediate improvement body; and an inner-side connection improvement body that connects the footings supported by the intermediate improvement body with the footing supported by the central improvement body, wherein a depth D1 of the outer periphery improvement body around each of the footings supported by the outer periphery improvement body, a depth D2 of the intermediate improvement body around each of the footings supported by the intermediate improvement body, and a depth D3 of the central improvement body around the footing supported by the central improvement body satisfy D1<D2<D3, a depth D10 of the outer periphery improvement body between adjacent footings supported by the outer periphery improvement body, and a depth D20 of the intermediate improvement body between adjacent footings supported by the intermediate improvement body satisfy D10=D1 and D20=D2, a width W1 of the outer periphery improvement body around each of the footings supported by the outer periphery improvement body, a width W2 of the intermediate improvement body around each of the footings supported by the intermediate improvement body, and a width W3 of the central improvement body around the footing supported by the central improvement body satisfy W1<W2<W3, a width W10 of the outer periphery improvement body between adjacent footings supported by the outer periphery improvement body satisfies W10<W1, a width W20 of the intermediate improvement body between adjacent footings supported by the intermediate improvement body satisfies W20<W2, a width W12 of the outer-side connection improvement body satisfies W12<W1, and a width W23 of the inner-side connection improvement body satisfies W23<W2.

4. The ground improvement body according to claim 3, wherein

W10=W20=W12=W23 is satisfied.

5. A ground improvement body comprising a horizontal plate-shaped upper improvement body and a lattice-shaped lower improvement body, the lower improvement body including at least:

an outer periphery improvement body that supports columns and footings at the outer peripheral part of the ground improvement body;

an intermediate improvement body that supports columns and footings that are spaced apart from the columns and the footings supported by the outer periphery improvement body toward the center part of the ground improvement body;

a central improvement body that supports a column and a footing of the center part of the ground improvement body;

an outer-side connection improvement body that connects the footings supported by the outer periphery improvement body with the footings supported by the intermediate improvement body; and an inner-side connection improvement body that connects the footings supported by the intermediate improvement body with the footing supported by the central improvement body, wherein a depth D1 of the outer periphery improvement body around each of the footings supported by the outer periphery improvement body, a depth D2 of the intermediate improvement body around each of the footings supported by the intermediate improvement body, and a depth D3 of the central improvement body around the footing supported by the central improvement body satisfy D1<D2<D3, a depth D10 of the outer periphery improvement body between adjacent footings supported by the outer periphery improvement body, and a depth D20 of the intermediate improvement body between adjacent footings supported by the intermediate improvement body satisfy D10=D1, D20=D23, a depth D12 of the outer-side connection improvement body and a depth D23 of the inner-side connection improvement body satisfy D12=D1 and D12<D23<D2, a width W1 of the outer periphery improvement body around the each of footings supported by the outer periphery improvement body, a width W2 of the intermediate improvement body around each of the footings supported by the intermediate improvement body, and a width W3 of the central improvement body around the footing supported by the central improvement body satisfy W1<W2<W3, a width W10 of the outer periphery improvement body between adjacent footings supported by the outer periphery improvement body satisfies W10<W1, a width W20 of the intermediate improvement body between adjacent footings supported by the intermediate improvement body satisfies W20<W2, a width W12 of the outer-side connection improvement body satisfies W12<W1, and a width W23 of the inner-side connection improvement body satisfies W23<W2.

6. The ground improvement body according to claim 5, wherein

W10=W20=W12=W23 is satisfied.

* * * * *